United States Patent [19]

McDowell

[11] 3,996,945

[45] Dec. 14, 1976

[54] EXTINGUISHER FOR CIGARETTES OR CIGARS

[76] Inventor: James A. McDowell, 3706 W. 147th St., Hawthorne, Calif. 90250

[22] Filed: Mar. 25, 1976

[21] Appl. No.: 670,140

Related U.S. Application Data

[63] Continuation-in-part of Ser. No. 566,010, April 7, 1975, Pat. No. 3,948,278.

[52] U.S. Cl. ..... 131/235 R; 131/241; 220/9 F

[51] Int. Cl.[2] ..... A24F 19/14

[58] Field of Search ..... 131/235, 242, 256, 236; 220/9 F; 206/245, 246, 133, 136

[56] References Cited

UNITED STATES PATENTS

| | | | |
|---|---|---|---|
| 2,208,072 | 7/1940 | Griffin | 131/236 |
| 2,657,090 | 10/1953 | Meer | 131/242 X |
| 3,191,608 | 6/1965 | Licata | 131/256 |

*Primary Examiner*—Stephen C. Pellegrino

*Attorney, Agent, or Firm*—Nilsson, Robbins, Dalgarn & Berliner

[57] ABSTRACT

A disposable receptacle for cigarettes or cigars is formed of top and bottom juxtaposed bodies of rigid, foamed thermoplastic polymer and a layer of inorganic fire-resistant material sandwiched therebetween, disposed in a metal foil shell. A rigid frame member is secured to the top body by perimeter foil portions.

8 Claims, 2 Drawing Figures

EXTINGUISHER FOR CIGARETTES OR CIGARS

CROSS REFERENCE TO RELATED APPLICATION

This application is a Continuation-In-Part of application Ser. No. 566,010, now U.S. Pat. No. 3,948,278 filed Apr. 7, 1975.

BACKGROUND AND SUMMARY OF THE INVENTION

A number of methods for the rapid extinguishment of cigarettes or cigars have been proposed, but each has had drawbacks. The usual method is to provide a layer of fine sand in a receptacle into which can be poked the lit end of a cigarette or cigar and which rapidly smothers the lit end. Other methods which have been proposed include devices which provide a reservoir of water into which the entire cigarette can be dropped, or a sponge is provided which in turn has contact with a reservoir of water. It will be appreciated that such devices often entail the use of expensive structures and themselves present a cleaning problem. Devices using substantial quantities of fine sand must be sifted, and the sand must be periodically replaced. Devices utilizing water to extinguish cigarettes or cigars often become eyesores and, unless often cleaned, generate undesirable odors. In this regard, one may consider the following patents: U.S. Pat. Nos. 2,063,717; 2,510,449; and 2,638,905.

In my prior application Ser. No. 566,010, a disposable receptacle was described formed of rigid, foamed thermoplastic polymer. The following prior art was cited therein: U.S. Pat. Nos. 2,208,072; 2,319,173; 2,638,905; 2,657,090; 2,861,577; and 3,804,239.

The present invention provides a receptacle of improved construction which overcomes the drawbacks of prior devices. The receptacle is formed to rapidly extinguish cigarettes or cigars and is of sufficiently inexpensive construction that it may be simply discarded. In particular, the drawbacks of prior devices are avoided and the above advantages are obtained by a provision of a disposable receptacle formed of top and bottom juxtaposed bodies, each formed of rigid, foamed thermoplastic polymer contained in a metal foil shell. A layer of inorganic fire-resistant material is sandwiched between the bodies to aid in rapid extinguishment of cigarettes or cigars poked through the top body. A rigid frame member is secured to the top body by folding thereover perimeter foil portions of the shell. When in use, one simply pokes the lit end of a cigarette or cigar into the top body whereby it is extinguished upon contact with the fire-resistant material. More specifically, the top body is sufficiently thin from top to bottom to enable penetration therethrough of the lit end of a cigarette or cigar. In a further embodiment, a cavity region is formed in the top body surface, having a floor spaced downwardly therefrom, so as to hold ashes and the like.

DETAILED DESCRIPTION

Figure 1:
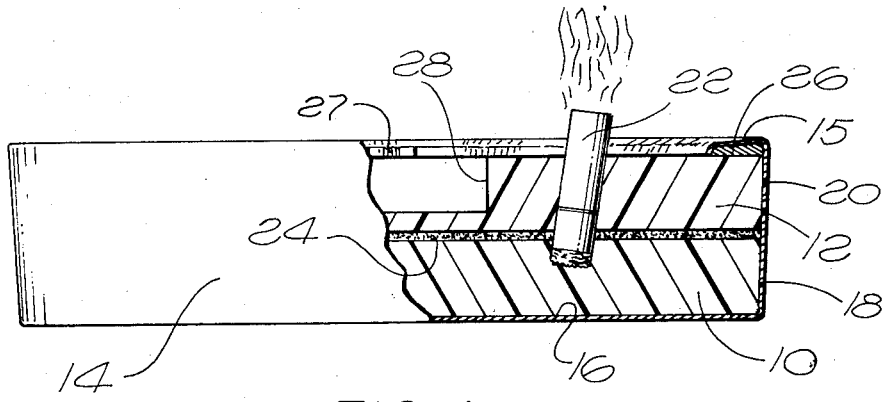
FIG. 1 is a partly elevational, partly cross-sectional view of a receptacle in accordance with the present invention, illustrating extinguishment of a cigarette therein.
Figure 2:
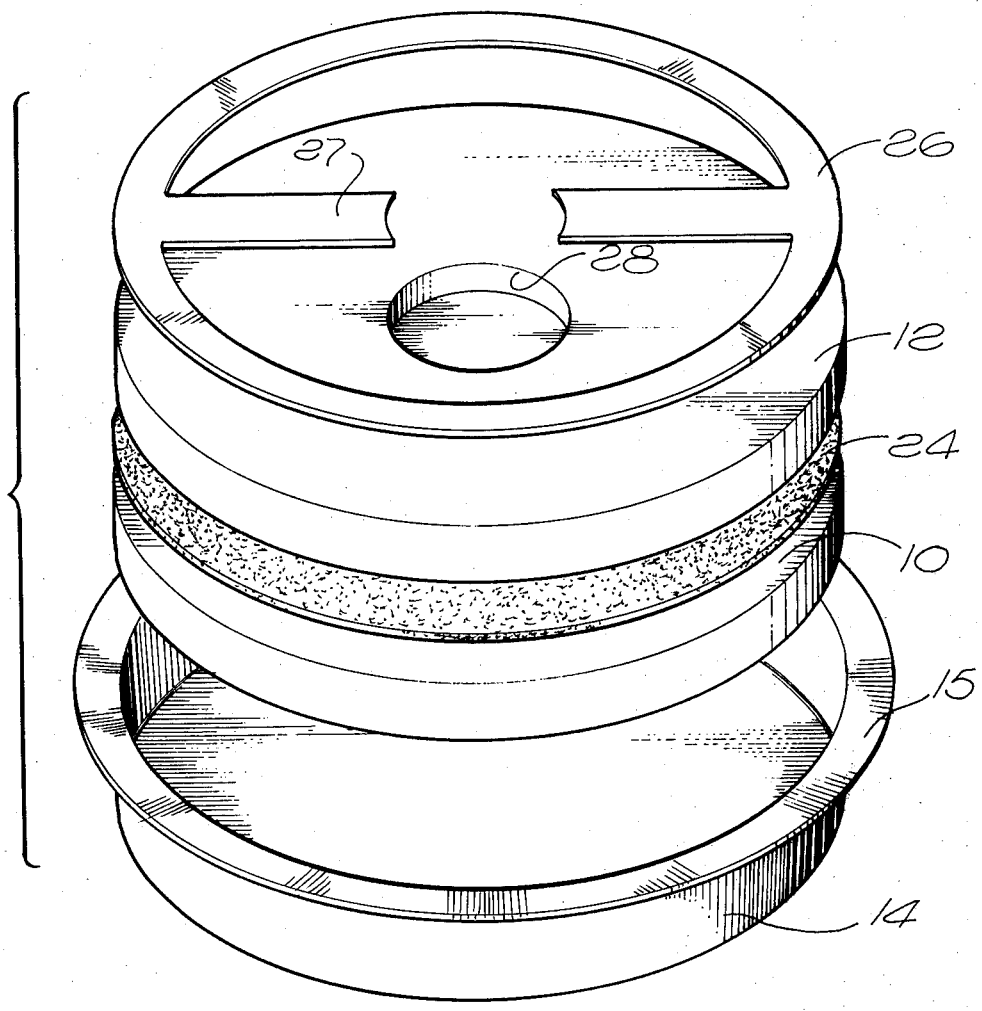
FIG. 2 is an exploded perspective view of the receptacle of FIG. 1.

Referring to FIG. 1, there is illustrated a disposable receptacle for cigarettes or cigars which is formed of a pair of juxtaposed bodies 10 and 12 of rigid, foamed thermoplastic polymer contained within a metal foil shell housing 14. One body 12 is disposed directly over the other body 10 and the two bodies 10 and 12 are contained in a shell housing 14. The housing 14 encloses the bottom surface 16 and side surfaces 18 and 20 of the polymer bodies 10 and 12. The top body 12 is sufficiently thin from top to bottom to enable penetration therethrough of a cigar or cigarette 22, as shown. In a particular embodiment illustrated, the polymer bodies 10 and 12 are each cylindrical, about ½ inch thick and about 5 inches in diameter. In further particulars, the top polymer body can be formed so as to define a central cavity 28 partly therethrough to serve as a receptacle for ashes.

In accordance herewith, a layer 24 of inorganic fire-resistant material is sandwiched between the bodies 10 and 12 and serves to rapidly extinguish the lit end of a cigar or cigarette poked therethrough. The fire-resistant material can be any inorganic material having refractory or fire-resistant properties, preferably in fine granular form having diameters in the range of 1–2000 microns. Suitable materials include talc, powdered chalk, mica, asbestos, granular silicon dioxide particles, small glass beads, kaolin, calcite, dolomite, gypsum salt, any of numerous aluminum silicate minerals, quartz, rutile, tremolite, and the like, and metals in powdered form such as copper, nickel, iron, and the like. The fire-resistant material can be disposed loosely on the top surface of the polymer body 10 or can be mixed with an adhesive material and applied as a layer, as shown at 24, on the body 10. Suitable adhesive materials include ordinary organic glues and such inorganic adhesives as sodium silicate and potassium silicate, or mixtures thereof.

The metal foil shell is formed so that its internal dimensions are in substantial conformance with the outer dimensions of the polymer bodies so as to close-fit the polymer bodies. In particular, one can choose aluminum foil, tin foil, or the like, to define the metal shell, or the shell can be of more rigid material if so desired. It will be appreciated however, that by using metal foil or the like, a very inexpensive receptacle is provided. Furthermore, in accordance with a preferred embodiment, a frame member 26 is provided formed of rigid material such cardboard, foil board, or the like. The frame member 26 is formed with a number of ears 27 extending from its inner edge to the outer edge of the central cavity 28. Perimeter extensions 15 of the shell 14 are folded over onto the frame member 26 to secure the assembly together.

The polymer body 10 is preferably formed of rigid foamed polystyrene as such material has excellent extinguishment properties. However, other rigid, foamed thermoplastic polymers can be used such as the foamed forms of polyurethane, polyethylene, polypropylene, styrene acrylonitrile copolymer, acrylonitrile-butadiene-styrene terpolymer, chlorinated polyethylene, polyvinylidene chloride, and the like.

Variations of the foregoing embodiments can be made in accordance with desired design characteristics and all such variations are intended to be covered to the extent that they are defined by the claims appended hereto.

I claim:

1. A disposable receptacle for cigarettes or cigars, comprising:

top and bottom juxtaposed bodies, each formed of rigid, foamed thermoplastic polymer and having bottom, side and top surfaces;

a layer of inorganic fire-resistant material sandwiched between said bodies; and a housing for containing said bodies and permitting a top surface portion of said top body to be exposed for extinguishment by penetration of the lit end of said cigarette or cigar.

2. The receptacle of claim 1 wherein said top body is sufficiently thin from top to bottom to enable penetration therethrough of a lit cigarette or cigar end.

3. The receptacle of claim 1 wherein said housing comprises a metal shell formed with internal dimensions in substantial conformance with the outer dimensions of said juxtaposed bodies.

4. The receptacle of claim 3 including a frame member of rigid material along the top edge surface of said top body, said shell having flexible perimeter portions for overlying said front member.

5. The receptacle of claim 4 wherein said border member is formed of cardboard.

6. The receptacle of claim 4 wherein said shell is of aluminum foil.

7. The receptacle of claim 1 wherein the top surface of said top body defines a cavity having a floor spaced downwardly therefrom for holding of cigarette or cigar ashes or the like.

8. The receptacle of claim 1 wherein said fire-resistant material is talc.

* * * * *